United States Patent [19]

Reinehr et al.

[11] 4,427,613

[45] Jan. 24, 1984

[54] CONTINUOUS PROCESS FOR THE PRODUCTION OF FILAMENTS OR FIBERS FROM DIFFICULTLY SOLUBLE SYNTHETIC POLYMERS

[75] Inventors: Ulrich Reinehr; Joachim Dross; Toni Herbertz, all of Dormagen; Hermann-Josef Jungverdorben, Grevenbroich; Hans K. Burghartz, Neuss, all of Fed. Rep. of Germany

[73] Assignee: Bayer Aktiengesellschaft, Leverkusen, Fed. Rep. of Germany

[21] Appl. No.: 279,898

[22] Filed: Jul. 2, 1981

Related U.S. Application Data

[63] Continuation of Ser. No. 110,165, Jan. 7, 1980, abandoned.

[30] Foreign Application Priority Data

Jan. 18, 1979 [DE] Fed. Rep. of Germany ..... 2901860

[51] Int. Cl.[3] ..... D02G 3/00

[52] U.S. Cl. ..... 264/206; 264/182

[58] Field of Search ..... 264/206, 182

[56] References Cited

U.S. PATENT DOCUMENTS

| | | | |
|---|---|---|---|
| 2,555,300 | 6/1951 | Calton et al. | 264/182 |
| 2,687,393 | 8/1954 | Trementozzi et al. | 264/182 |
| 2,773,047 | 12/1956 | Pirot et al. | 264/182 |
| 2,843,558 | 7/1958 | Fujisaki et al. | 264/182 |
| 2,953,538 | 9/1960 | Lyman | 264/182 |
| 3,010,932 | 11/1961 | Stoveken | 264/182 |
| 3,911,073 | 12/1975 | Massance | 264/171 |
| 4,185,058 | 1/1980 | Reinehr et al. | 264/49 |
| 4,239,722 | 12/1980 | Reinehr et al. | 264/206 |

FOREIGN PATENT DOCUMENTS

| | | | |
|---|---|---|---|
| 2706032 | 8/1978 | Fed. Rep. of Germany | 264/206 |

*Primary Examiner*—Jay H. Woo

*Attorney, Agent, or Firm*—Sprung, Horn, Kramer & Woods

[57] ABSTRACT

The invention relates to a process for the continuous production of synthetic non-discolored filaments and fibers from a filament forming synthetic polymer being difficultly soluble in an organic polar solvent particularly polyacrylonitrile polymers which process comprises preparing a suspension of said polymer and said solvent at room temperature and subsequently heating the suspension thus formed for at least 3 minutes to at least 130° C., and filtering the clear spinning solution formed without intermediate cooling, homogenizing and spinning it immediately afterwards into filaments.

6 Claims, No Drawings

CONTINUOUS PROCESS FOR THE PRODUCTION OF FILAMENTS OR FIBERS FROM DIFFICULTLY SOLUBLE SYNTHETIC POLYMERS

This is a continuation of application Ser. No. 110,165, filed Jan. 7, 1980, now abandoned.

BACKGROUND OF THE INVENTION

Numerous processes are known for producing spinnable solutions of polymerization products, such as polyacrylonitrile for example, for the production of synthetic filaments and fibers. For example, acrylonitrile polymers may be dissolved with stirring in dimethyl formamide or another polar organic solvent, such as dimethyl acetamide, dimethyl sulphoxide, etc., at a temperature of from 70° to 90° C., followed by filtering the resulting solution and spinning it into filaments. In this case, large vessels are generally used for technical reasons, with the result that the natural color of the spinning solutions is spoiled in the event of prolonged spinning times. In cases where less soluble polymers, for example polymers having a high K-value, or special polymers without any plasticizing comonomer components, such as acrylonitrile homopolymers, for example, are used, the dissolution temperatures generally have to be considerably increased in order to obtain spinnable, lump-free and gel-free and, above all, viscosity-stable solutions. This additional temperature burden on the spinning solution gives rise to serious problems in regard to its natural color and the retention thereof over a prolonged spinning period. Accordingly, there has been no shortage of proposals to overcome these problems. Broadly speaking, these proposals may be divided into two groups. The first group is based on additions to the spinning solution which positively affect its natural color, viscosity behavior and spinnability. The other group is based on special procedures for preparing homogeneous spinning solutions.

Of this latter group, particular emphasis is placed on German Patent Application No. P 41 52 29b, 3/65 which describes a process in which the size-reduced polymer is suspended in solvents and, after transfer to a heating zone, the resulting suspension is heated to a temperature (for example 150° C.) at which the solvent has a marked dissolving effect on the polymer and the clear colorless solution formed is spun into filaments. In this process, the solution formed in the heating zone is not "kept for any significant time at an elevated temperature" in order to prevent the color of the solution from being damaged. According to claim 2 and the Examples, this is understood to be a period of around 40 seconds.

Tests carried out with difficulty soluble polymers have shown that, although this process of suspending the polymer and subsequently transferring it to a heating zone is still the most suitable, the improvement in the natural color of the spinning solution is again offset by numerous spinning problems in the form of variations in denier and tackiness of the filaments. Thus, the use of this material, for example in the rayon sector, with its numerous texturing steps would give rise to difficulties. Capillary breaks, rucking and cracks occur to an increased extent.

SUMMARY OF THE INVENTION

It has now been found that difficultly soluble polymers may be processed by a continuous dissolving and spinning process to form filaments or fibers having a good natural color without any of the disadvantages referred to above, provided the difficultly soluble polymers to be spun are suspended in the spinning solvent used, the resulting suspension is heated for at least 3 minutes and preferably for 5 minutes to a temperature of at least 130° C. and preferably to a temperature of 150° C., and the inhomogeneous solution thus obtained is converted into a homogeneous, clear, viscosity-stable spinning solution having a good natural color, filtered and immediately delivered to the spinning jet.

Accordingly, the present invention is related to a process for the continuous production of synthetic non-discolored filaments and fibers from filament-forming synthetic polymers difficultly soluble in organic polar solvents by preparing a suspension of polymer and solvent at room temperature and subsequently heating the suspension thus formed, which comprises heating the suspension for at least 3 minutes to at least 130° C., and homogenising the clear spinning solution formed without intermediate cooling, filtering and spinning immediately afterwards into filaments.

According to the invention, difficultly soluble polymers are polymers having K-values of 90 and higher. Particularly preferred are acrylonitrile polymers containing at least 85% by weight of acrylonitrile, especially acrylonitrile homopolymers.

Suitable solvents are the polar organic solvents normally used in this art such as dimethyl acetamide, dimethyl sulphoxide, particularly dimethyl formamide.

The spinning solutions, which are preferably homogenised in static mixers, preferably have a solids content of from 24 to 30.5% by weight.

DETAILED DESCRIPTION OF THE INVENTION

According to the prior art, the spinning solvent, for example dimethyl formamide, is normally mixed with the polymer solid, for example polyacrylonitrile powder, in a mixer. The clear yellow solution formed is run off into an intermediate vessel, heated to the required temperature in an after-dissolver and introduced under pressure into a venting vessel. A pump then delivers the spinning solution into a spinning vessel, from which it is delivered through a filter to the spinning machine. A detailed description of a polyacrylonitrile dissolving unit of this type is given, for example, by F. Fourné in "Chemiefasern", May 21, 1971, page 372. The process according to the invention has the significant advantage over the conventional dissolving process that there is no need for large batches to be dissolved in vessels and circulated by pumps. At high vessel or after-dissolver temperatures, which are necessary for the preparation of stable spinning solutions on account of the poor solubility of certain polymers, serious color damage occurs as a result of the long spinning times and the resulting long residence times of the spinning solutions at high temperatures. In the process according to the invention, however, the spinning solution is only prepared in the quantity in which it is actually consumed. As already mentioned, it has been found that the application of high temperatures is not in itself sufficient to produce viscosity-stable spinning solutions. Another important factor is the residence time of the spinning solution at the temperatures applied. Viscosity measurements have shown that the residence time of, for example, acrylonitrile homopolymers having a K-value of 90 and higher must amount to at least 3 minutes and preferably to 5 minutes for a spinning solution concentration of around 25% in order to obtain viscosity-stable solutions. As the spinning solution concentration increases, the residence time of the spinning solution at high temperatures of 130° C. and higher has to be lengthened accordingly.

If solutions such as these are spun, variations in denier generally still occur, being reflected in the form of cracks in the fibre finally obtained. In order to avoid these difficulties, it has proved to be particularly suitable to subject the spinning solution to intensive mixing before or after filtration. Suitable units are, for example, static mixing elements in the form of combs, honeycomb lattices, blades or coils, several elements turned through 90° relative to one another generally being arranged one behind the other. An embodiment in which the mixing element is arranged immediately in front of the spinning jet has proved to be particularly favourable. This ensures intensive homogenization, effect heat exchange and optimal equalization of concentration, viscosity and temperature.

Suitable units for quick preparation of the solution are, for example, double-walled tubes which are heated with steam under a pressure of about 3 to 5 bars so that, on leaving the tube, the solution has a temperature of from 130° to 150° C. Depending on the number of spinning stations and the throughput of spinning solvent, this embodiment of a heating unit may be structurally dimensioned in such a way that the corresponding residence times may be adjusted to at least 3 minutes. In the following Examples, the viscosity of the spinning solutions is expressed in falling-ball seconds (measured in accordance with K. Jost, Rheologica Acta, Vol. 1, numbers 2 to 3 (1958), page 303). The parts and percentages quoted represent parts and percentages by weight, unless otherwise indicated.

EXAMPLES

The physical values mentioned above were determined as described below:

Determination of the color value:

A 5% solution of the corresponding fibre sample in dimethyl formamide is prepared by treatment for 30 minutes at 100° C. The solution is then cooled to room temperature and, if it is still slightly clouded, is centrifuged and measured in a 1 cm cell at 420 nm by comparison with pure DMF using a Zeiss Elko II-apparatus. A color value of up to about 0.25 represents visually bright white fibers. Color values of from about 0.25 to about 0.35 represent yellowish cream-colored fibers and color values above 0.35 represent pale-yellow to lemon-colored fibers.

Assessment of the spinning pattern:

In each spinning test, 100 pictures are taken of the filament cross-section and the number of variations in denier and bonds per 1000 capillaries is determined. With more than about 5 fluctuations in denier per 1000 capillaries, capillary breaks and rucking generally occur to an increased extent during the drawing process, leading to cracks and fluffy material. In addition, a marked tendency towards coiling on the winding units is observed, giving rise to frequent production stoppages.

EXAMPLES 1 TO 5

75.5 kg of dimethyl formamide are introduced into a vessel at room temperature with 24.5 kg of acrylonitrile homopolymer having a K-value of 91 (according to Fikentscher) and the suspension is pumped by a gear pump into a spinning vessel provided with a stirrer. The suspension, which has a solids concentration of 24.5% by weight, is then heated with steam under a pressure of 4.0 bars in a 60 cm long double-walled tube having an internal diameter of 8 cm. On leaving the tube after a residence time of 8 minutes, the solution has a temperature of 150° C. After leaving the heating unit, the spinning solution is filtered, passed through a tube fitted with several mixing combs and subsequently dry-spun in conventional manner from a 96-bore spinning jet. The spun material, which has a denier of 1670 dtex, is then drawn in a ratio of 1:9.6 over godets heated to 150° C. in a draw-twisting machine. Satisfactory running behaviour with no capillary breaks is achieved. Fiber strength 4.2 centinewtons/dtex, elongation at break 11%. Cross-section photographs taken under a microscope do not show any fluctuations in denier or bonds. The fibers, which have a final denier of 2.8 dtex, are observed to have T-shaped and Y-shaped cross-sections and are visually bright white in color. Color value=0.238.

Further tests with acrylonitrile homopolymers having different solids concentrations are summarised in Table 1 below. All the polymers were spun into fibers having a final denier of 2.8 dtex and textured in the same way as described in Example 1. In every case, texturing did not involve any problems.

TABLE 1

| Example No. | Polymer solids content % | Spinning pattern denier variations | Spinning pattern bonds | Cross-section | Color value | Strength cN/dtex | Breaking elongation % |
|---|---|---|---|---|---|---|---|
| 2 | 26 | 1 | 0 | T-form and trilobal | 0.215 | 4.6 | 11 |
| 3 | 27.5 | 1 | 0 | Horseshoe form | 0.200 | 4.7 | 12 |
| 4 | 29 | 1 | 0 | Horseshoe form | 0.218 | 4.5 | 10 |
| 5 | 30.5 | 2 | 0 | Cauliflower form | 0.204 | 4.3 | 12 |

As can be seen from Table 1, good processing properties with changes in the cross-section of structure are also obtained with highly concentrated spinning solutions of acrylonitrile homopolymer. In every case, the filaments are visually bright white in color.

EXAMPLE 6 (Comparison)

Similar quantities of dimethyl formamide and acrylonitrile homopolymer to those described in Example 1 are suspended in a screw and the resulting suspension is introduced into a vessel where it is heated with stirring for 3 hours to 90° C., resulting in the formation of a still slightly inhomogeneous solution, as reflected in the presence of undissolved particles and gel-like lumps in the solution, so that the solution appears clouded in transmitted light. This unfinished solution is then heated to 120° C. until it no longer appears clouded. After 30 minutes, the solution is filtered and, as described in Example 1, is directly spun into filaments having an overall denier of 1670 dtex. In the subsequent drawing test on a draw-twisting machine, capillary breaks and a tendency towards coiling are repeatedly observed. Spinning pattern: 11 to 12 fluctuations in denier per 1000 capillaries, no bonds. The fibers, which have a final denier of 2.8 dtex, appear cream to light yellow in color. Color value=0.360.

EXAMPLES 7 TO 14

Examples 7, 8, 12, 13 and 14 are Comparison Examples.

A spinning solution is prepared in the same way as described in Example 1, except that the residence time of the spinning solution in the heating unit was shortened by changing the throughput. The quantity of spinning solution delivered was measured in such a way that a residence time of 60 seconds in the heating unit was obtained after leaving the heatable tube. The solution was then filtered, homogenized and spun into filaments having a denier of 1670 dtex in the same way as described in Example 1. In the subsequent drawing test on a draw-twisting machine, processing was impossible. Capillary breaks repeatedly occurred. Spinning pattern: 16 to 17 fluctuations in denier per 1000 capillaries, 1 to 2 bonds per 1000 capillaries. The fibers are visually bright white in color, but are characterised by thick and thin zones along the individual capillaries, which may even be manually detected in the form of nodes. Color value=0.109.

Further tests, in which the residence time and the temperature of the spinning solution in the heating unit described in Example 1 were varied, are summarized in Table 2 below. The residence time of the spinning solution was varied by changing not only the throughput, but also the number of heating units used. A spinning solution having the same chemical composition and concentration as in Example 1 was used in every case.

TABLE 2

| Example No. | Heating unit number | Heating unit temperature °C. | Heating unit residence time (minutes) | Spinning pattern denier variations | Spinning pattern bonds | Color value | Process on a draw-twisting machine |
|---|---|---|---|---|---|---|---|
| 8 | 1 | 150 | 1.3 | 13 | 0 | 0.142 | capillary breaks |
| 9 | 1 | 150 | 3.0 | 3 | 0 | 0.133 | positive |
| 10 | 2 | 150 | 4.5 | 1 | 0 | 0.164 | positive |
| 11 | 3 | 150 | 7.0 | 0 | 0 | 0.161 | positive |
| 12 | 1 | 130 | 3.0 | 2 | 1 | 0.178 | some rucking |
| 13 | 1 | 120 | 3.0 | 15 | 4 | 0.093 | capillary breaks |
| 14 | 2 | 120 | 4.5 | 13 | 4 | 0.107 | capillary breaks |

As can be seen from Table 2, the natural color of the fibers is good in every case and improves with decreasing temperature. However, the spinning solution should be heated for at least 3 minutes to 130° C. in order to obtain viscosity-stable solutions. It is only in this way that satisfactory processing on the draw-twisting machine is possible.

EXAMPLES 15 TO 19 (Comparison)

A spinning solution was prepared, filtered and spun in the same way as in Example 1, except that the static mixer consisting of several mixing combs was not used. The spun material, having a denier of 1670 dtex, was then drawn in a ratio of 1:9.6 on a draw-twisting machine. Capillary breaks and a tendency towards coiling on the cops repeatedly occurred. Spinning pattern: 8 to 9 fluctuations in denier per 1000 capillaries, 3 to 4 bonds. The fibers had a good natural color corresponding to Example 1. Color value=0.203.

Further tests with different solids concentrations are summarized in Table 3 below. All the polymers were spun as in Example 15 into filaments having an overall denier of 1670 dtex and were subsequently tested by drawing in a ratio of 1:9.6 on a draw-twisting machine.

TABLE 3

| Example No. | Polymer solids content % | Spinning pattern denier fluctuations | Spinning pattern bonds | Color value | Processing on the draw-twisting machine |
|---|---|---|---|---|---|
| 16 | 26 | 6–7 | 3–4 | 0.211 | many capillary breaks and cracks |
| 17 | 27.5 | 11–12 | 4–5 | 0.221 | very many capillary breaks and cracks |
| 18 | 29 | 14–15 | 3–4 | 0.207 | very many capillary breaks and cracks, material extremely fluffy |
| 19 | 30.5 | 19–20 | 7–8 | 0.213 | very many capillary breaks and cracks, material extremely fluffy |

It can be seen from Table 3 that the spinning pattern deteriorates (increase in denier fluctuations, bonds and cracks) with increasing polymer solids concentration. In the absence of the static mixing combs, processing on the draw-twisting machine is virtually impossible (marked tendency towards coiling, capillary breaks and fluffy material).

We claim:

1. A process for the continuous production of synthetic non-discolored filaments and fibers from an acrylonitrile homopolymer which comprises preparing a suspension consisting essentially of said polymer in dimethyl formamide at room temperature and subsequently heating the suspension thus formed for at least 3 minutes to at least 130° C., and filtering the clear spinning solution formed without intermediate cooling, homogenizing said solution by means of a static mixer and spinning it immediately afterwards into filaments having K-values of at least 90.

2. The process of claim 1, wherein the spinning solution has a solid concentration of from 24 to 30.5% by weight.

3. A process according to claim 1, wherein said suspension is heated to at least 150° C.

4. A process according to claim 1, wherein said solution is dry-spun into filaments.

5. A process according to claim 1, wherein said suspension is heated for a period of time of from 3 to 8 minutes at a temperature of at least 130° C.

6. A process according to claim 5, wherein said solution is dry-spun.

* * * * *